United States Patent [19]

Watts

[11] 4,088,380

[45] May 9, 1978

[54] THREAD AND BOBBIN STORAGE CASE FOR EXISTING SEWING MACHINE CABINETS

[76] Inventor: Edith B. Watts, Rte. 5, Box 733, Thomasville, N.C. 27360

[21] Appl. No.: 762,839

[22] Filed: Jan. 27, 1977

[51] Int. Cl.[2] ..... A47B 57/06

[52] U.S. Cl. ..... 312/237; 312/294; 312/306; 223/106

[58] Field of Search ..... 112/217.1, 218 R ; 223/106, 107, 108, 109; 312/294, 306, 312, 237; 108/148; 49/451, 414, 418, 428; 160/90, 115

[56] References Cited

U.S. PATENT DOCUMENTS

| | | | |
|---|---|---|---|
| 473,898 | 5/1892 | Baldwin | 49/428 |
| 601,386 | 3/1898 | Stephenson | 223/107 X |
| 612,786 | 10/1898 | Persons | 112/217.1 |
| 1,231,303 | 6/1917 | Seligman | 312/312 X |
| 1,242,916 | 10/1917 | Brooks | 223/107 X |
| 1,313,498 | 8/1919 | Nason | 312/312 X |
| 2,442,147 | 5/1948 | Recklitis | 49/418 |
| 3,080,620 | 3/1963 | Mendelsohn | 160/90 X |
| 3,083,419 | 4/1963 | Pennington et al. | 160/90 X |
| 3,297,387 | 1/1967 | Parsons | 112/217.1 |
| 3,542,446 | 11/1970 | Joyce | 312/312 X |

FOREIGN PATENT DOCUMENTS

| | | | |
|---|---|---|---|
| 771,042 | 7/1934 | France | 112/217.1 |
| 706,603 | 5/1941 | Germany | 312/312 |
| 3,258 | 3/1890 | United Kingdom | 312/237 |

*Primary Examiner*—George H. Krizmanich

[57] ABSTRACT

A storage case for holding spools of thread and bobbins is so designed as to be mountable on an outer vertical wall of practically any existing sewing machine cabinet. The case includes an outer frame which is mounted on an exterior wall of the sewing machine cabinet and a vertically slidable drawer unit therein. Partitions within the drawer unit include upright spindles for holding the thread and bobbins in place. The drawer unit further includes a resiliently biased, frictional connecting means between the frame and drawer unit for holding the drawer in any desired raised, open position whereby the thread or bobbins may be removed for use.

5 Claims, 4 Drawing Figures

THREAD AND BOBBIN STORAGE CASE FOR EXISTING SEWING MACHINE CABINETS

BACKGROUND OF THE INVENTION

There are various types of sewing accessory cabinets, thread and bobbin cases, etc., which have been developed through the years. U.S. Pat. No. 1,242,916 to Brooks and U.S. Pat. No. 2,238,033 to Carlson, both reveal thread and bobbin storage compartments which are built integrally into sewing machine cabinets. U.S. Pat. No. 2,619,926 to Holden discloses a bobbin holder attachment for sewing machine cabinets and is mounted on top of the cabinet to the right of the machine head, and would not be suitably mounted in any other position. The attachment of Holden includes a cover which pivots from a closed to an opened position for removal of the thread or bobbin. Since this storage case is attached to the top surface of the machine cabinet, it frequently interferes with the operation of the machine and otherwise takes up space which could be useful during operation of the sewing machine. Another device for storage of sewing articles and accessories is disclosed in U.S. Pat. No. 3,312,380 to Wages, which cabinet is designed to be mounted on a room wall in proximity to the sewing area. While this device may be convenient in many instances, there are other instances when the sewing machine cabinet may not be located near a wall thereby necessitating the operator's getting up and moving to the accessory storage cabinet when other equipment is needed.

Of somewhat more significance with regard to the present invention is the Parsons U.S. Pat. No. 3,297,387 which discloses a sewing machine cabinet including a well or chamber extending vertically into the rear portion of the adjacent drawer unit. Within this permanent chamber in the cabinet a vertically slidable sewing accessory rack is movably positioned such that the rack may be pulled upward to reveal thread holding and dispensing means. The difficulty with the Parsons' invention lies in the fact that the chamber or well is an integral part of the sewing machine cabinet and must be built thereinto when the cabinet is constructed. It cannot be applied to existing cabinets. Additionally the drawer or rack may be held in only the full upright position. Further, the Parsons rack can only be attached within the cabinet drawer unit which is not available on all sewing machine cabinets. In order to secure the drawer in the open position it must be pulled completely upward and moved rearwardly and downwardly to engage a tab which is on the back panel of the drawer and which rests on the back panel of the vertical chamber to hold the drawer in an open position. It is therefore completely open or completely closed.

SUMMARY OF THE PRESENT INVENTION

The present invention is directed to a thread and bobbin storage unit which may be marketed separately and easily mounted on the back or side wall of practically any existing sewing machine cabinet with or without drawer units. The storage unit is designed such that it requires little additional space to the rear of the machine cabinet and yet will provide storage for approximately three dozen spools of thread and one to two dozen bobbins. The unit includes a supporting frame which is mounted to an outer surface of the existing machine cabinet and which is adapted for holding in a vertically movable position a drawer or rack having an open front, a top wall, bottom wall and a pair of side walls. The drawer further includes at least one partition member extending horizontally between the side walls and including upright spindle devices for holding the spools of thread and bobbins in place. A resiliently biased frictional connecting device joins the side walls of the drawer to the frame, so that the drawer may be raised to any open position and remain in that open position until a positive force is applied to move it elsewhere.

The sewing accessory storage case of the present invention may be constructed from a variety of materials including wood, metal, or some of the lightweight, but strong, rigid plastics which are used in vacuum forming and/or injecting molding processes. For economy and durability, however, the preferred construction material is one of the lighter weight plastics.

Tubular cylindrical spacers extend forwardly from the edges of the frame structure and form the channel through which attaching screws are fastened into the outer cabinet wall. The spacers are situated such that the vertical path of the rack is outside the overhanging portion of some cabinet tops, and the top of the accessory case may be positioned in coplanar relationship with the upper surface of the machine cabinet. The spacers may be removed if there is no overhang.

It is anticipated, though not shown in any of the accompanying drawings, that the accessory case could also be used for holding supplies other than thread and bobbins. The upright spindles could be omitted from certain areas of the partition to allow placement of scissors and other devices kept close at hand by seamstresses. Depending upon the selection of materials for production of the case, the design as discussed herein provides a most economical answer to the storage problem faced by many who sew. Many seamstresses must cope with rather cramped quarters whether in their home sewing centers or in the workshops of clothing stores and other industries. The accessory case of the present invention can provide an economical solution to many of these storage problems, make it available to most consumers, and can be easily attached to existing sewing machine cabinets.

It is therefore an object of the present invention to provide a thread and bobbin storage case which may be attached to the exterior wall of practically any existing sewing machine cabinet.

It is a further object of the present invention to provide a sewing accessory storage case which will require minimal additional space when it is attached to the exterior wall of a sewing machine cabinet.

It is also an object of the present invention to provide a sewing accessory storage case in which thread, bobbins, and other accessories may be stored in an orderly and easily accessible environment.

Other objects of the present invention and the structure by which they are accomplished will be evident by studying the following detailed specification in conjunction with the accompanying drawings, in which.

DETAILED DESCRIPTION OF THE PREFERRED EMBODIMENT

Figure 1:
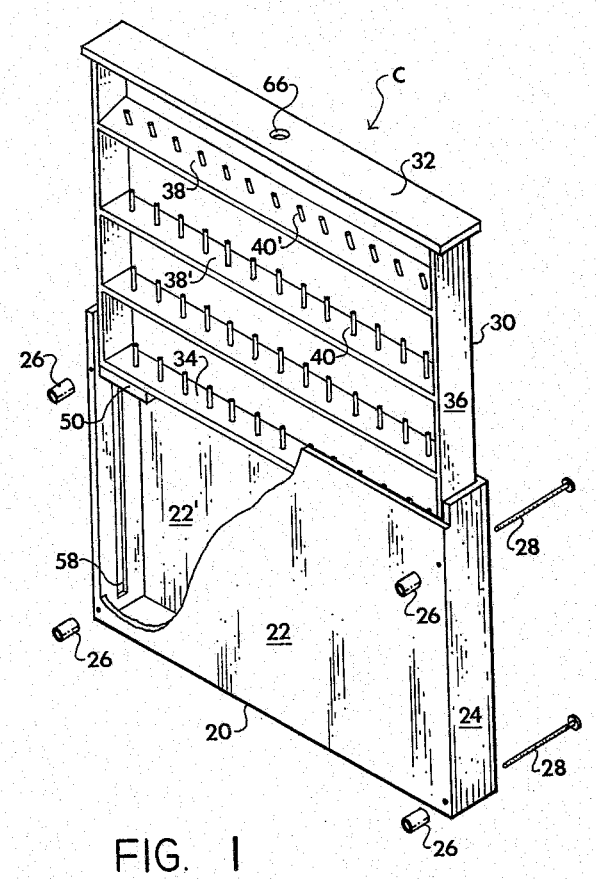
FIG. 1 is a perspective view of the sewing accessory storage case according to a preferred embodiment removed from the cabinet.

Referring now to FIG. 1, the sewing accessory storage case C includes, in general a supporting frame 20 and a vertically mounted, sliding drawer 30. The outer casing or supporting frame 20 includes a front wall 22 and a rear wall 22' and a pair of side walls 24. In addition to supporting the drawer 30 the surrounding walls of frame 20 protect the thread and other accessories stored in the drawer from environmental elements as dust, moisture etc. A trackway or groove 58 extends longitudinally of and along the inner surface of each side wall 24, and terminates at a point spaced from the upper end thereof. Groove 58 is a depression which extends only partially through the thickness of each side wall and only partially of the vertical dimension of each side wall. Attached to and extending forwardly at right angles from the front edges of each side wall 24 are one or more tubular spacers 26 which are used for mounting the frame onto the machine cabinet by means of screws 28 which extend through cooperating openings in side walls 24, spacers 26, and into or through the wall of the machine cabinet.

The drawer 30 is of such a size that it will fit snugly, but slidably within the supporting frame 20. The drawer 30 includes a top wall 32, a bottom wall 34, and a pair of opposing side walls 36. Additionally, one or more partitions 38,38' are mounted between the side walls 36. Attached to the bottom wall 34 and intermediate partitions 38,38' are upright spindles 40 which hold the thread and bobbins in place in the drawer. It should be noted that the partition 38 is slanted upwardly from front to rear and that the spindles 40' on this partition are shorter than the spindles 40 on partition 38' and the bottom wall 34. The partition 38 is slanted and the spindles 40 are made shorter specifically for holding bobbins which are conventionally a shorter spool than those upon which sewing threads are sold and stored. Therefore it is not necessary to have the spindles as long as those which are designated to hold threads and the slanted partition facilitate access for the fingers between the partitions 38 and the top wall 32.

Figure 4:
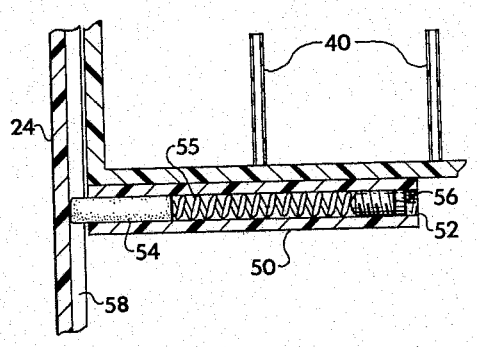
FIG. 4 is an enlarged side view, with parts broken away and partially in section, illustrating a drawer corner and the resiliently biased frictional connecting means.

The resiliently biased, frictional connecting means illustrated in FIG. 4 is described as follows. Attached to the undersurface of the bottom wall 34 adjacent the opposite sides thereof are a pair of stop plates 50 including a partially threaded, horizontally extending passageway 52 therethrough. Housed within the passageway 52 are a resilient plug 54, a spring 55, and an adjusting screw 56. Plug 54 (preferably of rubber or some other material with a relatively high coefficient of friction) extends slightly outwardly from the end of passageway 52 and actually fit within grooves 58. The adjusting screw 56 engages the plug 54 preferably through spring 55 to push the plug against the base (not shown) of the groove 58. The resilience of the plug allows movement responsive to a positive force, but restraint otherwise, so that when the drawer is pulled vertically into the desired open position the plug 54 will hold the drawer in position by a friction force against the wall 24. Movement of the adjusting screw 56 also compresses spring 55 and varies the amount of force necessary to move the drawer 30.

The construction of the accessory case C in the preferred embodiment is from a lightweight, but strong, moldable plastic material. The material may be translucent, so that the threads and bobbins are visible without opening the drawer or may be of a color to match the wood grain of the cabinet 60.

Figure 2:
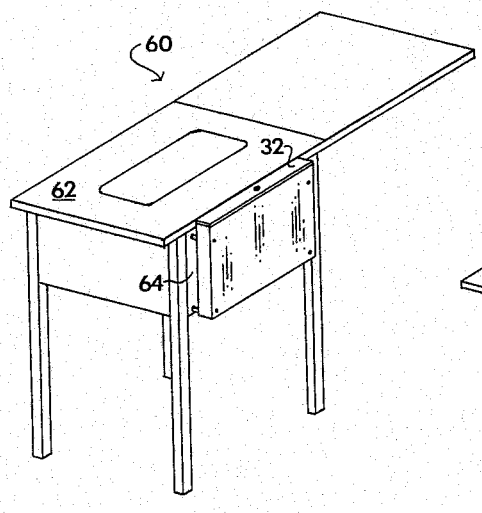
FIG. 2 is a perspective view of the storage accessory case of the present invention attached to the exterior rear wall of an existing sewing machine cabinet.
Figure 3:
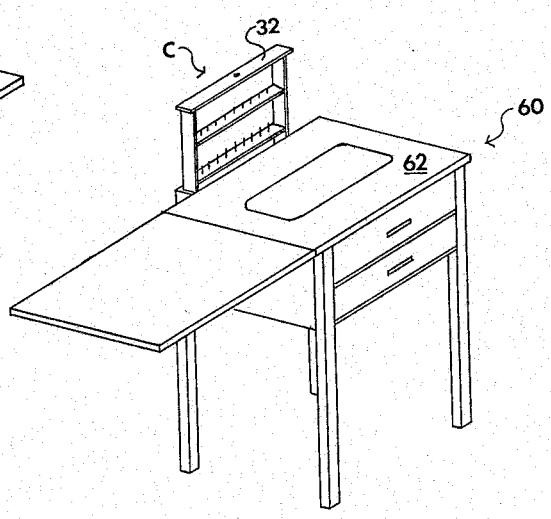
FIG. 3 is a perspective view looking from the front of the sewing machine cabinet with the sewing accessory storage case in a raised open position.

Referring to FIG. 2 the accessory case C is shown mounted on sewing machine cabinet 60. In the illustration the cabinet 60 includes a top wall 62 and a rear wall 64. The top wall 62 is generally of a larger dimension than that of the cabinet frame which is defined by the rear wall 64 and the adjoining side and front walls, thereby creating an overhang. The preferred positioning of case C on the machine cabinet 60 is to the rear of the machine head at a level so that the top surface of the drawer 32 or the case C is flush with the top surface 62 of the cabinet. It is desired that the two surfaces be flush so that when operating a machine any fabric or material will move smoothly over the two surfaces and not gather or bunch against the case C. To provide clearance past the overhang of the top surface 62, spacers 26 on the supporting frame 20 offset the case C from the rear wall of the sewing machine cabinet.

To mount the case on the machine cabinet the upper spacers 26 are placed on screws 28 between side walls 24 of the frame 20 and rear wall 64 of the cabinet. The passageway in each spacer receives a screw or bolt 28, which extends from the rear through an opening through the side wall 24 and into or through the rear wall 64. To support the weight of the case a spacer 26 and screw 28 are placed substantially at each of the four corners of the case, therefore the weight is supported equally by each of the four screws which extend through the channels.

To lift the drawer an indention or opening 66 is situated in the top wall 32 of the drawer. A conventional handle, which would extend above the top surface of the drawer, is not desirable because it too would interfere with the smooth flow of material from the machine head toward the back of the cabinet. The opening 66 is gripped by one or more fingers and the drawer 30 is pulled vertically upward to a desired open position. As mentioned hereinabove the drawer is held in open position by the rubber plug 54 which frictionally engages the inner surface of the groove 58. If there is difficulty in maintaining the drawer in an upright open position, it is an easy procedure to turn the adjusting screw 56 inwardly against the spring 55 and plug 54 to increase the friction against the groove wall. Use of this type of holding device is desirable because it permits the placement of the drawer in a plurality of open positions without the use of clips which might malfunction or be operable only in certain preselected positions. After the thread or bobbins are removed from the case for use the drawer 32 is pushed downward into the frame 20 in a closed position whereby the top surface 32 of the drawer is flush with the top edges of frame walls 22, 22', 24.

While a preferred embodiment has been illustrated where the case C is mounted against the rear of the machine cabinet, it is possible within the scope of the invention to modify the case as to position it on any existing structure whether it be a wall, shelf, table, table legs or the like. Also, other resiliently biased, frictional connections are possible to slidably mount drawer 30 within frame 20. Furthermore, although the case C is illustrated exclusively for bobbins and thread spools, it is possible that some of the spindles 40 may be removed or deleted in certain areas to permit storage for other accessories such as scissors, pin cushions and other devices used in sewing. It is also to be understood that other changes and modifications may be made to the present invention without departing from the scope of the invention which is set forth in the claims below.

What is claimed is:

1. In combination with a sewing machine cabinet of the type having an upper surface from which a sewing machine head extends and is selectively retractable, a sewing accessory storage case comprising:

(a) a housing including spaced side walls, and at least a rear wall, and attachment means associated therewith for releasably securing said housing against an existing exterior wall or a sewing machine cabinet with said rear wall being spaced from said existing wall;

(b) a drawer having at least a top wall and a pair of side walls slidably received within said housing for vertical movement;

(c) said drawer further including at least one partition member extending horizontally between said drawer side walls and including a plurality of upwardly extending spindles mounted thereon;

(d) resiliently biased, frictional connecting means extending between said drawer and said housing for holding said drawer in a multiplicity of raised, open positions whereby sewing accessories may be removed therefrom.

2. The sewing accessory storage case according to claim 1 wherein said resiliently biased, frictional connecting means includes a rubber plug mounted for horizontal movement on each side wall of said drawer outwardly from the side surface thereof, and an adjusting means selectively movable against said rubber plug to vary the distance from the plug tip and the side wall from which it extends, whereby said plug engages and applies frictional pressure against the corresponding surface of said housing hold the drawer in the absence of a positive force applied in a vertical direction.

3. The sewing accessory storage case according to claim 2 and further including a stop plate attached to the undersurface of the lowermost of said partition members adjacent each end thereof, said stop plate including a horizontal, at least partially threaded passageway therethrough providing open communication to an outermost point adjacent the corresponding side wall of the housing, said rubber plug received within the outermost portion of said passageway, said adjusting means including a threaded screw within the passageway which, when activated moves the plug outwardly.

4. The sewing accessory storage case according to claim 3, wherein said side walls of said housing include a vertical trackway extending partially through the thickness of said wall and terminating at points spaced from the upper and lower ends of said side walls and receiving said rubber plug, whereby said plug provides a resiliently biased, frictional connecting means as well as a guide for said drawer as it is moved vertically.

5. The sewing accessory storage case according to claim 1 wherein a spacer means is positioned between said cabinet wall and said housing to offset said case from said wall and so position said case that the vertical path of said drawer is free from any cabinet top overhang.

* * * * *